US012789247B2

(12) United States Patent
Kim et al.

(10) Patent No.: US 12,789,247 B2
(45) **Date of Patent: *Nov. 10, 2026**

(54) HOT STAMPING COMPONENT

(71) Applicant: Hyundai Steel Company, Incheon (KR)

(72) Inventors: Hye Jin Kim, Incheon (KR); Jin Ho Lee, Incheon (KR); Je Youl Kong, Incheon (KR); Seung Chae Yoon, Incheon (KR); Seung Pill Jung, Incheon (KR); Hyun Yeong Jung, Incheon (KR); Kyu Yeon Hwang, Incheon (KR)

(73) Assignee: HYUNDAI STEEL COMPANY, Incheon (KR)

( * ) Notice: Subject to any disclaimer, the term of this patent is extended or adjusted under 35 U.S.C. 154(b) by 640 days.

This patent is subject to a terminal disclaimer.

(21) Appl. No.: 18/079,402

(22) Filed: Dec. 12, 2022

(65) Prior Publication Data

US 2023/0138738 A1 May 4, 2023

Related U.S. Application Data

(63) Continuation of application No. PCT/KR2022/001502, filed on Jan. 27, 2022.

(30) Foreign Application Priority Data

Oct. 29, 2021 (KR) ..... 10-2021-0147068

(51) Int. Cl.

| | |
|---|---|
| ***B21D 22/02*** | (2006.01) |
| ***B21D 35/00*** | (2006.01) |
| ***C21D 1/18*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.

CPC ..... *B21D 22/022* (2013.01); *B21D 22/02* (2013.01); *B21D 35/005* (2013.01); *C21D 1/185* (2013.01); *C21D 9/46* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C22C 38/38* (2013.01); *C21D 2211/001* (2013.01); *C21D 2211/008* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 10,286,439 | B2 | 5/2019 | Jin et al. | |
| 11,377,703 | B2 | 7/2022 | Yi et al. | |
| 11,446,901 | B2 | 9/2022 | Kong et al. | |
| 11,505,846 | B2 | 11/2022 | Abukawa et al. | |
| 11,566,311 | B2 | 1/2023 | Suzuki | |
| 2013/0095347 | A1* | 4/2013 | Kawasaki | B21B 45/00 148/333 |
| 2022/0119929 | A1 | 4/2022 | Fujinaka et al. | |
| 2023/0125659 | A1* | 4/2023 | Kim | C22C 38/28 148/330 |
| 2023/0132597 | A1* | 5/2023 | Yoo | C22C 38/32 420/84 |

FOREIGN PATENT DOCUMENTS

| | | | |
|---|---|---|---|
| EP | 2436796 | A1 | 4/2012 |
| EP | 2581465 | A1 | 4/2013 |
| EP | 3483299 | A1 | 5/2019 |
| JP | 2001-131670 | A | 5/2001 |
| JP | 2006-152427 | A | 6/2006 |
| JP | 2010-150612 | A | 7/2010 |
| JP | 2018-003051 | | 1/2018 |
| JP | 2019-014939 | A | 1/2019 |
| JP | 6795042 | B2 | 12/2020 |
| JP | 2022-013657 | A | 1/2022 |
| KR | 10-2018-0095757 | A | 8/2018 |
| KR | 10-2019-0036367 | A | 4/2019 |
| KR | 10-2019-0042563 | A | 4/2019 |
| KR | 10-2020-0036248 | A | 4/2020 |
| KR | 10-2020-0126484 | A | 11/2020 |
| KR | 10-2021-0120477 | A | 10/2021 |
| KR | 10-2021-0127235 | A | 10/2021 |
| WO | 2007/129676 | A1 | 11/2007 |
| WO | 2016079565 | A1 | 5/2016 |
| WO | 2018/134874 | A1 | 7/2018 |
| WO | 2020222394 | A1 | 5/2020 |

OTHER PUBLICATIONS

Notification of Third Party Submission issued Jun. 15, 2023 in corresponding Korean Application No. 10-2021-0147068.
International Search Report issued Jan. 31, 2023 in corresponding PCT Application No. PCT/KR2022/001502.
Office Action issued Apr. 9, 2024 in corresponding Japanese Patent Application No. 2022-575482.
Extended European Search Report dated Jul. 31, 2025 for corresponding EP Patent Application No. 22817503.0.
Action issued Apr. 23, 2026 in corresponding Indian Patent Application No. 202417033983.

* cited by examiner

*Primary Examiner* — Jophy S. Koshy
(74) *Attorney, Agent, or Firm* — Fox Rothschild LLP

(57) ABSTRACT

Provided is a hot stamping component having a tensile strength of 1680 Mpa or greater including a microstructure comprising prior austenite grains (PAGs), and an average grain diameter of the PAGs is 25 μm or less.

3 Claims, 9 Drawing Sheets

| HOT STAMPING CONDITION | HOT STAMPING TIME 5 MINUTES | HOT STAMPING TIME 10 MINUTES | RESULTS |
|---|---|---|---|
| 870 ℃ |  |  | NOT FRACTURED |
| 900 ℃ |  |  | NOT FRACTURED |
| 930 ℃ |  |  | NOT FRACTURED |
| 950 ℃ |  (d1) |  (d2) | FRACTURED |

HOT STAMPING COMPONENT

CROSS-REFERENCES TO RELATED APPLICATIONS

This application is a continuation application of PCT/KR2022/001502 filed Jan. 27, 2022, which claims priority of Korean Patent Application 10-2021-0147068 filed on Oct. 29, 2021. The entire contents of these applications are incorporated herein by reference in their entirety.

TECHNICAL FIELD

The present disclosure relates to a hot stamping component.

BACKGROUND

As environmental and fuel economy regulations are strengthened around the world, a need for light vehicle materials is increasing. Accordingly, research and development on ultra-high strength steel and hot stamping steel are being actively carried out. A hot stamping process is generally made of heating/forming/cooling/trimming, and uses phase transformation of a material and a change of a microstructure during the process.

Recently, study to improve delayed fracture, corrosion resistance, and weldability in a hot-stamped part manufactured by the hot stamping process has been actively performed. As a related technology, there is Korean Patent Publication No. 10-2018-0095757 (Invention Title: Manufacturing method of Hot-Stamping Component), etc.

SUMMARY

Technical Problem

The present disclosure provides a hot stamping component with improved hydrogen induced stress corrosion cracking resistance.

However, the problem is an example, and the scope of the present disclosure is not limited thereto.

Technical Solution

According to an aspect of the present disclosure, a hot stamping component having a tensile strength of 1680 Mpa or greater includes a microstructure comprising prior austenite grains (PAGs), and an average grain diameter of the PAGs is 25 μm or less.

A grain boundary forming an interface of the microstructure may include a low angle grain boundary having a grain angle of 0 degree or greater and 15 degrees or less and a high angle grain boundary having a grain angle exceeding 15 degrees and 180 degrees or less, and a fraction of the low angle grain boundary may be 20% or greater.

The high angle grain boundary may include a special grain boundary with a regular atomic arrangement and a random grain boundary with an irregular atomic arrangement.

A fraction of the special grain boundary may be 5% or greater and 10% or less.

A fraction of the random grain boundary may be 70% or less.

The hot stamping component of may include a martensite phase having an area fraction of 95% or greater in the hot stamping component.

The hot stamping component of may include a base steel plate, and the base steel sheet may include, with respect to a total weight of the base steel sheet, an amount of 0.28 wt % to 0.50 wt % of carbon (C), an amount of 0.15 wt % to 0.7 wt % of silicon (Si), an amount of 0.5 wt % to 2.0 wt % of manganese (Mn), an amount of 0.03 wt % or less of phosphorus (P), an amount of 0.01 wt % or less of sulfur (S), an amount of 0.1 wt % to 0.6 wt % of chromium (Cr), an amount of 0.001 wt % to 0.005 wt % of boron (B), at least one of titanium (Ti), niobium (Nb), and molybdenum (Mo), and the balance of iron (Fe) and other unavoidable impurities.

Advantageous Effects

According to an exemplary embodiment of the present disclosure made as described above, the hot stamping component with improved hydrogen induced stress corrosion cracking resistance may be implemented. However, the scope of the present disclosure is not limited by the effect.

DETAILED DESCRIPTION

Figure 1:
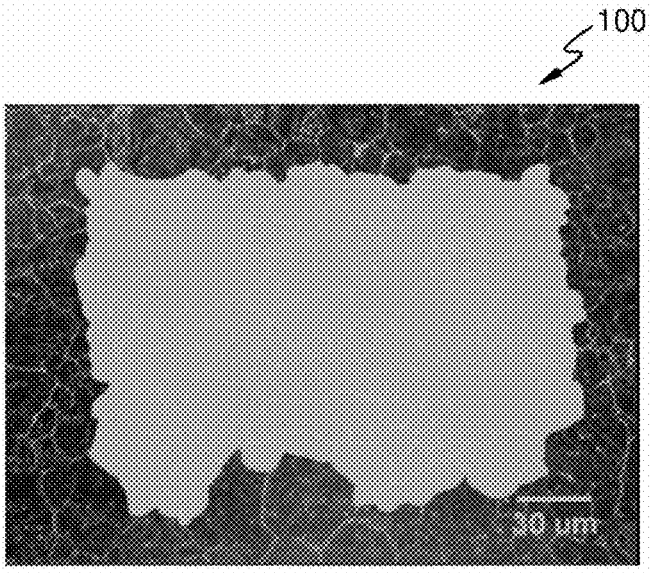
FIG. 1 shows an enlarged image of a part of a cross-section of a hot stamping component according to an exemplary embodiment of the present disclosure.

The present disclosure may have various modifications thereto and various embodiments, and thus particular embodiments will be illustrated in the drawings and described in detail in a detailed description. Effects and features of the present disclosure, and a method of achieving them will be apparent with reference to the embodiments described in detail in conjunction with the drawings. However, the present disclosure is not limited to the embodiments disclosed below, but may be implemented in various forms.

Hereinafter, embodiments of the present disclosure will be described in detail with reference to the accompanying drawings, and in description with reference to the drawings, the same or corresponding components are given the same reference numerals, and redundant description thereto will be omitted.

Herein, the terms such as first, second, etc., have been used to distinguish one component from other components, rather than limiting.

Herein, singular forms include plural forms unless apparently indicated otherwise contextually.

Herein, the terms "include", "have", or the like, are intended to mean that there are features, or components, described herein, but do not preclude the possibility of adding one or more other features or components.

Herein, when a portion, such as a film, a region, a component, etc., is present on or above another portion, this case may include not only a case where it is directly on the other portion, but also a case where another film, region, component, etc., is arranged between the portion and the other portion.

Herein, when a film, a region, a component, etc., are connected, the case may include a case where they are directly connected, or/and a case where they are indirectly connected, having another film, region, and component therebetween. For example, herein, when a film, a region, a component, etc., are electrically connected, the case may include a case where they are directly electrically connected, and/or a case where they are indirectly electrically connected, having another film, region, and component therebetween.

Herein, "A and/or B" may indicate A, B, or both A and B. In addition, "at least one of A and B" may indicate A, B, or both A and B.

The x-axis, y-axis, and z-axis are not limited to the three axes of the orthogonal coordinate system, and may be interpreted in a broad sense including the axes. For example, the x-axis, y-axis, and z-axis may be orthogonal to each other, but may refer to different directions that are not orthogonal to each other.

Herein, when a certain embodiment may be implemented otherwise, a particular process order may be performed differently from the order described. For example, two processes described in succession may be performed substantially simultaneously, or may be performed in an order reverse to the order described.

In the drawings, the size of components may be exaggerated or reduced for convenience of description. For example, the size and thickness of each component shown in the drawings are shown for convenience of description, and thus the present disclosure is not necessarily limited to the illustration.

FIG. 1 shows an enlarged image of a part of a cross-section of a hot stamping component according to an exemplary embodiment of the present disclosure.

Referring to FIG. 1, a hot stamping component 100 according to an exemplary embodiment of the present disclosure may have a tensile strength of 1680 MPa or greater and a yield of 950 MPa or greater. The hot stamping component 100 may include a base steel sheet and a plating layer covering at least one surface of the base steel sheet.

The plating layer may include, for example, aluminum (Al). In this case, the plating layer may include aluminum-iron (Al—Fe) and aluminum-iron-silicon (Al—Fe—Si) compounds by mutual diffusion of Fe of the base steel sheet and Al of the plating layer.

The base steel sheet may be a steel sheet manufactured by performing a hot-rolling process and/or a cold rolling process with respect to a slab cast to include a predetermined content of a predetermined alloy element. In an exemplary embodiment, the base steel sheet may include carbon (C), silicon (Si), manganese (Mn), phosphorus (P), sulfur (S), chromium (Cr), boron (B), the remainder iron (Fe), and other unavoidable impurities. In an exemplary embodiment, the base steel sheet may further include, as an additive, at least any one of titanium (Ti), niobium (Nb), and vanadium (V). In another embodiment, the base steel sheet may further include a predetermined content of calcium (Ca).

Carbon (C) may function as an austenite stabilizing element in the base steel sheet. Carbon is a main element that determines the strength and hardness of the base steel sheet, and may be added to secure the tensile strength of the base steel sheet (e.g., the tensile strength of 1680 MPa or greater and the yield strength of 950 MPa or greater) and to secure hardenability properties, after a hot stamping process. Carbon may be included in an amount of about 0.28 wt % to about 0.50 wt % with respect to a total weight of the base steel sheet. When a content of carbon is less than 0.28 wt %, it is difficult to satisfy the mechanical strength of the base steel sheet because a hard phase (martensite, etc.) is difficult to secure. On the other hand, when a content of carbon exceeds 0.50 wt %, brittleness may occur in the base steel sheet or bending performance of the base steel sheet may be reduced.

Silicon (Si) may function as a ferrite stabilizing element in the base steel sheet. Silicon (Si), which is a solid solution strengthening element, improves the strength of the base steel sheet and improves a concentration of carbon in austenite by suppressing formation of a low-temperature carbide. Silicon is a key element in hot rolling, cold rolling, hot pressing, structure homogenization (perlite, manganese segregation zone control), and fine dispersion of ferrite. Silicon may act as a martensitic strength heterogeneity control element to improve crashworthiness. Silicon may be included in an amount of about 0.15 wt % to about 0.7 wt % with respect to a total weight of the base steel sheet. When a content of silicon is less than 0.15 wt %, the foregoing effect is difficult to obtain, and cementite formation and coarsening may occur in a final hot stamping martensitic structure, and the equalization effect of the base steel sheet is insignificant, and a V-bending angle may not be secured. On the other hand, when a content of silicon exceeds 0.7 wt %, hot rolling and cold rolling loads increase, a hot-rolled red scale becomes excessive, and plating properties of the base steel sheet may be deteriorated.

Manganese (Mn) may function as an austenite stabilizing element in the base steel sheet. Manganese may be added to increase hardenability and strength in thermal treatment. Manganese may be included in an amount of about 0.5 wt % to about 2.0 wt % with respect to a total weight of the base steel sheet. When a content of manganese is less than 0.5 wt %, a hard phase fraction in a molded article after hot stamping may be insufficient due to insufficient hardenability caused by the insufficient hardenability effect. On the other hand, when a content of manganese exceeds 2.0 wt %, the ductility and toughness may be reduced by manganese segregation or pearlite bands, resulting in degradation of bending performance and causing a heterogeneous microstructure.

Phosphorous (P) may be included in an amount greater than 0 and equal to or less than about 0.03 wt % with respect to a total weight of the base steel sheet to prevent the toughness of the base steel sheet from being reduced. When a content of phosphorous exceeds about 0.03 wt %, an iron phosphide compound is formed, degrading toughness and weldability and causing a crack in the base steel sheet during a manufacturing process.

Sulfur (S) may be included in an amount greater than 0 and equal to or less than about 0.01 wt % with respect to a total weight of the base steel sheet. When a content of sulfur exceeds 0.01 wt %, hot workability, weldability, and impact characteristics may be degraded and a surface defect such as a crack, etc., may occur due to generation of a giant inclusion.

Chrome (Cr) may be added to improve the hardenability and strength of the base steel sheet. Chrome makes it possible to refine grains and secure strength through precipitation hardening. Chrome may be included in an amount of about 0.1 wt % to about 0.6 wt % with respect to a total weight of the base steel sheet. When a content of chrome is less than 0.1 wt %, the precipitation hardening effect is low, and on the other hand, when a content of chrome exceeds 0.6 wt %, Cr-based precipitate and matrix solid solution amount increase, degrading toughness, and cost price increases, increasing production cost.

Boron (B) may be added to secure hardenability and strength of the base steel sheet by securing a martensitic structure by suppressing the transformation of ferrite, pearlite and bainite. Boron may be segregated in a grain boundary to less grain boundary energy to increase hardenability, and may have a grain refining effect by increasing an austenite grain growth temperature. Boron may be included in an amount of about 0.001 wt % to about 0.005 wt % with respect to a total weight of the base steel sheet. Boron, when included in the foregoing range, may prevent the occurrence of hard phase intergranular brittleness and secure high toughness and bendability. The hardenability effect may be insufficient when a content of boron is less than 0.001 wt %, and on the other hand, when a content of boron exceeds 0.005 wt %, boron may be easily precipitated in a grain boundary according to a heat treatment condition due to a low solid solubility, degrading hardenability or causing hot embrittlement, and toughness and bendability may be degraded due to occurrence of hard phase intergranular brittleness.

Meanwhile, fine precipitates may be included in the base steel sheet according to according to an exemplary embodiment of the present disclosure. An additive constituting some of elements included in the base steel sheet may be a nitride or carbide forming element contributing to formation of fine precipitates.

The additive may include at least any one of titanium (Ti), niobium (Nb), or vanadium (V). Titanium (Ti), niobium (Nb), and vanadium (V) may form fine precipitates in the form of nitrides or carbides, thereby securing the strength of a hot stamped and quenched member. Moreover, they may be contained in a Fe—Mn-based composite oxide, may function as an effective hydrogen trap site for improving the delayed fracture resistance, and may be elements necessary for improving the delayed fracture resistance.

More specifically, titanium (Ti) may be added to strengthen grain refinement and upgrade a material by forming precipitates after hot pressing heat treatment, and may form a precipitation phase such as TiC and/or TiN, etc., at high temperatures, thereby effectively contributing to austenite grain refinement. Titanium may be included in an amount of about 0.025 wt % to about 0.045 wt % with respect to a total weight of the base steel sheet. When titanium is included in the content range, casting defects and precipitate coursing may be prevented, the physical property of a steel material may be easily secured, and a defect such as occurrence of a crack, etc., on a surface of the steel material may be prevented. On the other hand, when a content of titanium exceeds 0.045 wt %, a precipitate may be coarsened, degrading elongation and bendability.

Niobium (Nb) and molybdenum (Mo) may be added to increase strength and toughness according to a decrease in a martensite packet size. Niobium may be included at about 0.045 wt % or less, for example, in an amount of about 0.015 wt % to about 0.045 wt % with respect to a total weight of the base steel sheet. Molybdenum may be included in an amount of about 0.015 wt % or less, for example, at about 0.05 wt % to about 0.015 wt % with respect to a total weight of the base steel sheet. When niobium and molybdenum are included in the foregoing range, a grain refining effect of the steel material in hot rolling and cold rolling processes may be excellent, occurrence of a crack in a slab in steelmaking/soft casting and occurrence of brittleness rupture in a product may be prevented, and generation of a steelmaking coarse precipitate may be minimized.

The base steel sheet according to the exemplary embodiment may be a steel sheet manufactured by performing a hot-rolling process and/or a cold rolling process with respect to a slab cast to include a predetermined content of a predetermined alloy element. Such a base steel sheet may be present as a full austenite structure at a hot stamping heating temperature, and may transform into a martensite structure upon cooling thereafter. A martensite phase is a result of diffusionless transformation of austenite y under an initiation temperature Ms of martensite transformation during cooling.

The hot stamping component 100 may include prior austenite grains (PAGs) as a microstructure. In an exemplary embodiment, the base steel sheet may include an area fraction of 95% or greater of the martensite phase. The PAGs may be generally distributed inside the martensite phase.

On the other hand, when the hot stamping component 100 is exposed to a corrosive environment such as crevice corrosion, hydrogen induced stress corrosion cracking in which cracks propagate along a grain boundary from the surface where hydrogen (H) generated during the corrosion reaction is fractured by tensile stress may occur. Resistance to such hydrogen induced stress corrosion cracking may be improved by controlling the size of the PAGs.

Accordingly, in the hot stamping component 100 according to an exemplary embodiment, the average size of the PAGs may be 25 μm or less, more specifically, 5 μm or greater and 25 μm or less. When the average size of the PAGs is formed to be 5 μm or greater and 25 μm or less, resistance to hydrogen induced stress corrosion cracking may be improved in the same stress and corrosion environment. Forming the average size of the PAGs to be less than 5 μm is practically impossible in the hot stamping process, and when the average size of the PAGs is coarsened exceeding 25 μm, this is because hydrogen easily permeates and diffusible hydrogen moving along the grain boundary increases, so that cracks are easily propagated along a hydrogen movement path. In addition, because the density of hydrogen existing along the grain boundary increases, the probability of delay fracture due to hydrogen may increase.

The average size of the PAGs may be controlled by adjusting the hot stamping process time and temperature. In an exemplary embodiment, the hot stamping process is performed by multi-stage heating, and the temperature range of a heating furnace during the hot stamping process may be 680° C. to 1,000° C. In addition, in an exemplary embodiment, the total dwell time in the heating furnace during the hot stamping process may be 100 seconds to 900 seconds. When the hot stamping process is performed under the above conditions, it is possible to form the average size of the PAGs to be 25 μm or less, more specifically, 5 μm or greater and 25 μm or less. In this regard, the hot stamping process will be described below in detail with reference to FIGS. 5 and 6.

Figure 2:
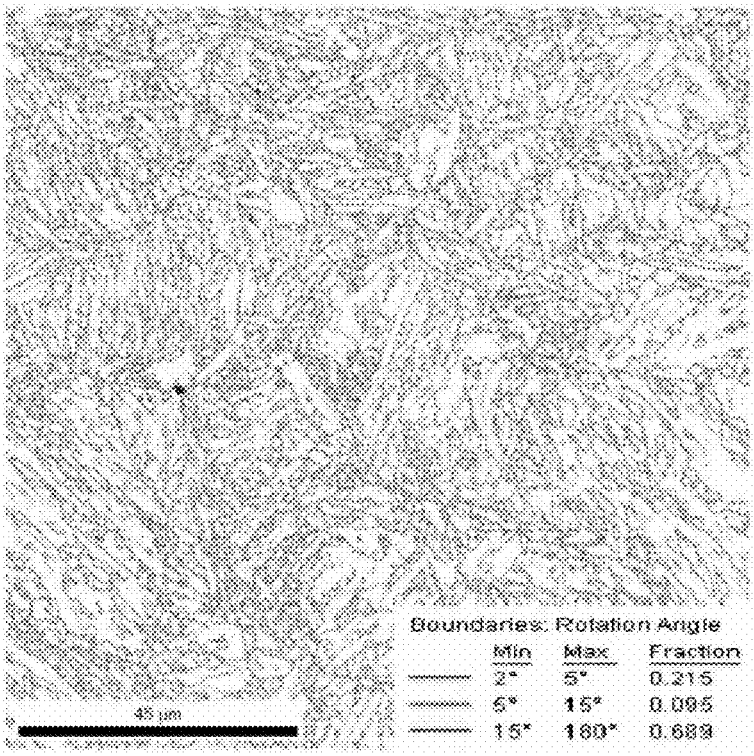
FIG. 2 shows an electron backscattered diffraction (EBSD) analysis image of a hot stamping component according to an exemplary embodiment of the present disclosure.
Figure 3:
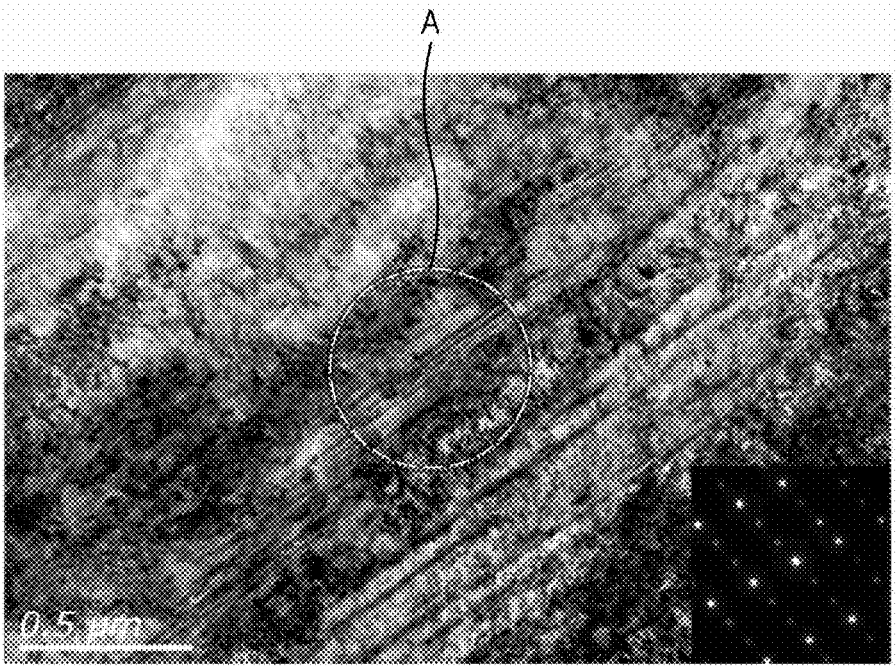
FIG. 3 shows an enlarged image of a part of a cross-section of a hot stamping component according to an exemplary embodiment of the present disclosure.
Figure 4:
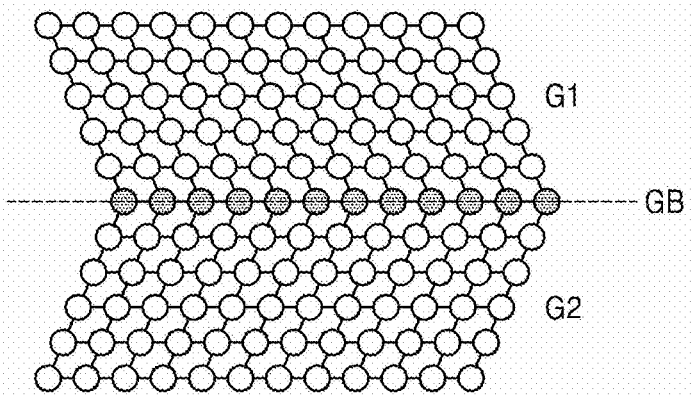
FIG. 4 shows a state in which a microstructure of a hot stamping component according to an exemplary embodiment of the present disclosure forms a special grain boundary.

FIG. 2 is an electron backscattered diffraction (EBSD) analysis image of a hot stamping component according to an exemplary embodiment of the present disclosure. FIG. 3 is an enlarged image of a part of a cross-section of a hot stamping component according to an exemplary embodiment of the present disclosure. FIG. 4 shows a state in which a microstructure of a hot stamping component according to an exemplary embodiment of the present disclosure forms a special grain boundary.

The martensite phase according to an exemplary embodiment of the present disclosure includes a plurality of characteristic microstructure units. For example, the microstructure in the martensite phase may have a fine and complex shape in which PAGs, packets, and laths hierarchically overlap. Here, the lath has a rod shape oriented in parallel in a specific direction, and the packet may be defined as a region including a group of laths. Packets and laths may be included in PAGs.

The microstructures in the hot stamping component 100 form a grain boundary forming an interface between microstructures. Here, the grain boundary (or particle boundary) may mean a boundary having a low atom density where two or more microstructures having an arrangement of different directions are in contact with each other. In the present disclosure, the grain boundary may mean an interface between PAGs, an interface between packets, and an interface between laths.

In an exemplary embodiment, the grain boundary of the microstructure in the hot stamping component 100 may include a low angle grain boundary with a small grain angle and a high angle grain boundary with a relatively large grain angle. The low angle grain boundary may mean a grain boundary where the angle between two microstructures in contact with each other is 0 degree or greater and 15 degrees or less, and the high angle grain boundary may mean a grain boundary where the angle between two microstructures in contact with each other exceeds 15 degrees and is 180 degrees or greater.

Referring to FIG. 2, the low angle grain boundary and the high angle grain boundary may be measured through electron backscattering diffraction (EBSD) analysis. In FIG. 2, red and green lines represent the low angle grain boundary with a grain angle 15 degrees or less, and a blue line represents the high angle grain boundary with a grain angle exceeding 15 degrees and 180 degrees or less.

In an exemplary embodiment, the hot stamping component 100 may include a fraction of 20% or more of the low angle grain boundary having the grain angle 0 degree or greater and 15 degrees or less at a fraction, and a fraction of 80% or less of the high angle grain boundary having the grain angle exceeding 15 degrees and 180 degrees or less. A large grain angle means that the energy of the grain boundary is high, and conversely, a low grain angle means that the energy of the grain boundary is low. The grain boundary with high energy act as a nucleation site for solid phase reaction such as diffusion, phase transformation, and precipitation. Therefore, the higher the energy of grain boundary, the easier the hydrogen in the steel sheet is activated as diffusible hydrogen, and such diffusible hydrogen is vulnerable to stress corrosion cracking, which may diffuse the propagation of cracks. Therefore, in the hot stamping component 100 according to an exemplary embodiment of the present disclosure, a fraction of 20% or greater of the low angle grain boundary with relatively low energy is secured, and thus, energy crack propagation may be effectively prevented by reducing the hydrogen diffusion path.

For example, the hot stamping component 100 may include a fraction of 80% of less of the high angle grain boundary having the grain angle exceeding 15 degrees and 180 degrees or less. The high angle grain boundary may include a special grain boundary and a random grain boundary. The random grain boundary is a grain boundary having an irregular arrangement of atoms, and is a relatively unstable interface due to high energy of the grain boundary. Cracks in the hot stamping component 100 generally progress along such an unstable interface, and therefore, in order to prevent fracture of the hot stamping component 100 due to corrosion, it is required to control the random grain boundary to be less than a certain ratio.

Accordingly, the hot stamping component 100 according to an exemplary embodiment may include a fraction of 70% or less of the random grain boundary among the high angle grain boundary having the grain angle exceeding 15 degrees and 180 degrees or less. When 70% or greater of the random grain boundary is distributed, the interface energy between microstructures in the hot stamping component 100 increases, which may act as a hydrogen diffusion path and a crack propagation path. Accordingly, by controlling 70% or less of the random grain boundary, the unstable interface between the microstructures in the hot stamping component 100 is reduced to a certain ratio, thereby preventing hydrogen in the steel sheet from being activated as diffusible hydrogen.

In addition, the hot stamping component 100 may include a fraction in a range of 5% to 10% of the special grain boundary among the high angle grain boundary. FIG. 3 shows an enlarged image of a lath structure among the microstructures of the hot stamping component 100 according to an exemplary embodiment, and it may be seen that the special grain boundary appear especially in part A.

More specifically, the special grain boundary is a grain boundary of a special structure called a twinning boundary or a coherent Σ3 boundary, and means a phenomenon in which two microstructures are symmetrically attached with a plane or axis disposed therebetween. In general, the high angle grain boundary is randomly generated, but a regular atomic arrangement may appear in some structures by diffusion through a heat treatment process such as an annealing process. Due to the regularity of atomic arrangement such as a symmetrical shape, the twinning boundary is in a matching state. It is possible to effectively reduce the embrittlement mechanism by serving as a stable hydrogen trap site for diffusible hydrogen and effectively acting as a stable site for crack propagation.

FIG. 4 shows an arrangement between particles of a special grain boundary. FIG. 4 shows an atomic arrangement of a first grain G1 and a second grain G2 that are in contact with each other with respect to a grain boundary GB. At this time, the grain boundary GB formed by the first grain G1 and the second grain G2 may be an interface between lath and lath, an interface between lath and packet, or an interface between packet and packet. An atom constituting the first grain G1 and an atom constituting the second grain G2 may be symmetrically formed by forming a matching interface as shown in FIG. 4. A grain angle according to the arrangement of atoms of the first and second grains G1 and G2 may be classified as an obtuse high angle grain boundary, but the energy of the grain boundary GB may be significantly less than that of random grain boundary. This is because atoms of the special grain boundary are provided to have a stable arrangement along the grain boundary GB. Therefore, such a special grain boundary has low energy and act as a trap site for diffusible hydrogen, thereby preventing crack propagation by reducing the movement of hydrogen. For example, the special grain boundary may be distributed at greater than about 90% on the interface between lath and lath, lath and packet, or an interface between packet and packet.

The hot stamping component 100 according to an exemplary embodiment of the present disclosure includes the fraction in a range of 5% to 10% of the special grain boundary so that hydrogen introduced during hydrogen induced stress corrosion cracking is trapped in the special grain boundary, thereby effectively blocking the movement of diffusible hydrogen by increasing a hydrogen trapping effect. In addition, the fraction between 5% and 10% of the special grain boundary is provided among the high angle grain boundary in the hot stamping component 100, and thus, the fraction of the random grain boundary having a high energy interface may be relatively reduced.

In a manufacturing method of the hot stamping component according to an exemplary embodiment of the present disclosure, a multi-stage heating method is employed in a heating furnace upon heating for hot stamping. Hereinafter, a manufacturing method of a hot stamping component according to an exemplary embodiment of the present disclosure will be described in detail with reference to FIGS. 5 and 6.

Figure 5:
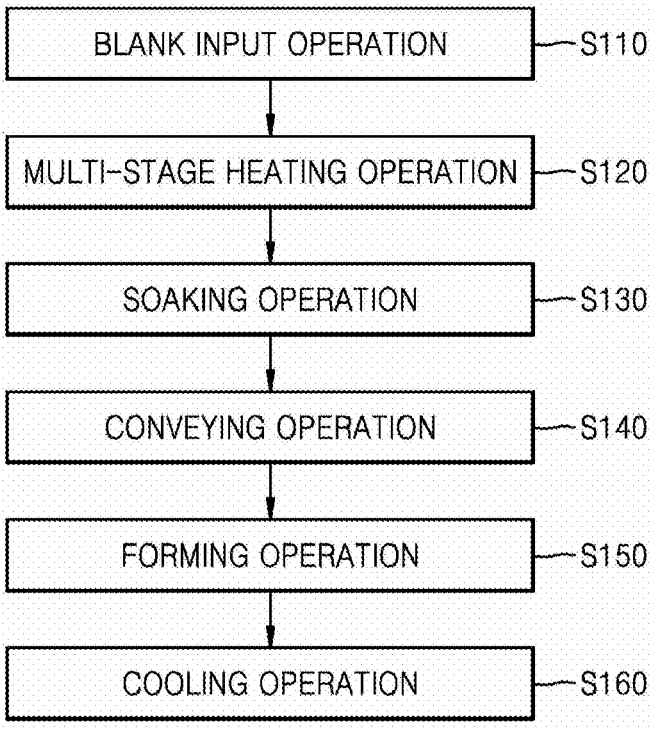
FIG. 5 shows a flowchart schematically illustrating a manufacturing method of a hot stamping component according to an exemplary embodiment of the present disclosure.
Figure 6:
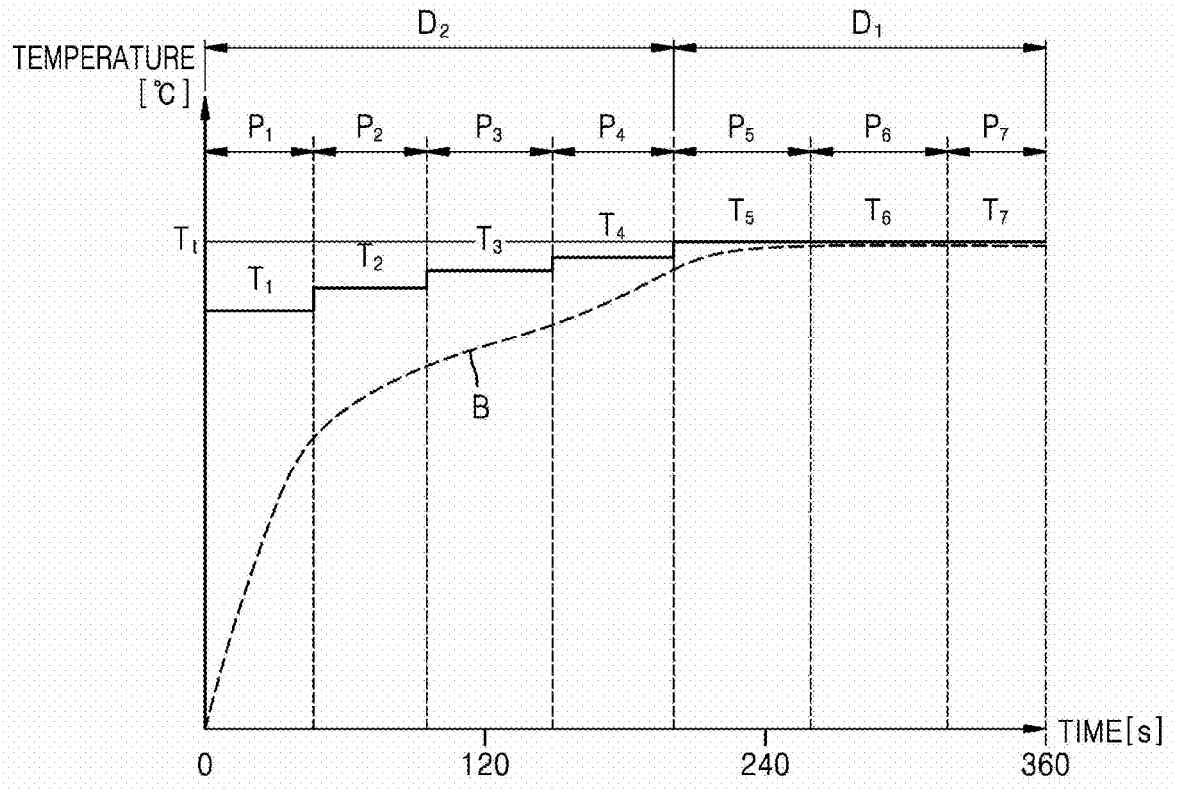
FIG. 6 shows a diagram for explaining a blank heating operation of FIG. 5.

FIG. 5 shows a flowchart schematically illustrating a manufacturing method of a hot stamping component according to an exemplary embodiment of the present disclosure. FIG. 6 is a diagram for explaining a blank heating operation of FIG. 5.

Referring to FIG. 5, the manufacturing method of the hot stamping component according to an exemplary embodiment of the present disclosure may include the blank input operation (S110), a multi-stage heating operation (S120) and a soaking operation (S130), and further include a conveying operation (S140), a forming operation (S150), and a cooling operation (S160) after the soaking operation (S130).

First, the blank input operation (S110) may be an operation of injecting a blank into a heating furnace having a plurality of sections of different temperature ranges.

The blank injected into the heating furnace may be formed by cutting a plate material for forming the hot stamping component. The plate material may be manufactured through a process of performing hot rolling or cold rolling on a steel slab and then annealing heat treatment. In addition, after the annealing heat treatment, a plating layer may be formed on at least one surface of the annealed heat treatment plate material.

The entire temperature of the heating furnace may be 680° C. to 1000° C. Specifically, the entire temperature of the heating furnace in which the multi-stage heating operation (S210) and the soaking operation (S220) are performed may be 680° C. to 1000° C. In this regard, the temperature of the heating furnace in which the multi-stage heating operation (S210) is performed may be 680° C. to Ac3, and the temperature of the heating furnace in which the soaking operation (S220) is performed may be in the range of Ac3 to 1000° C.

The blank injected into the heating furnace may be conveyed in a conveying direction after being mounted on a roller.

After the blank input operation (S110), the multi-stage heating operation (S120) may be performed. The multi-stage heating operation (S120) may be an operation in which the blank is heated in stages while passing through a plurality of sections provided in the heating furnace. In the multi-stage heating operation (S120), the heating furnace according to an exemplary embodiment may have the plurality of sections of different temperature ranges. More specifically, as shown in FIG. 6, the heating furnace may have a first section $P_1$ of a first temperature range $T_1$, a second section $P_2$ of a second temperature range $T_2$, a third section $P_3$ of a third temperature range $T_3$, a fourth section $P_4$ of a fourth temperature range $T_4$, a fifth section $P_5$ of a fifth temperature range $T_5$, a sixth section $P_6$ of a temperature range $T_6$, and a seventh section $P_7$ of a seventh temperature range $T_7$.

The first section $P_1$ to the seventh section $P_7$ may be sequentially disposed in the heating furnace. The first section $P_1$ of the first temperature range $T_1$ may be adjacent to an entrance of the heating furnace into which the blank is injected, and the seventh section $P_7$ of the seventh temperature range $T_7$ may be adjacent to an exit of the heating furnace through which the blank is discharged. Therefore, the first section $P_1$ of the first temperature range $T_1$ may be a first section of the heating furnace, and the seventh section $P_7$ of the seventh temperature range $T_7$ may be a last section of the heating furnace. As will be described below, among the plurality of sections of the heating furnace, the fifth section $P_5$, the sixth section $P_6$, and the seventh section $P_7$ may not be sections in which multi-stage heating is performed, but may be sections in which soaking is performed.

The temperature of the plurality of sections provided in the heating furnace, for example, the temperature of the first section $P_1$ to the seventh section $P_7$, may increase in a direction from the entrance of the heating furnace into which the blank is injected to the exit of the heating furnace through which the blank is taken out. However, the temperature of the fifth section $P_5$ to the seventh section $P_7$ may be the same. In addition, a temperature difference between two sections adjacent to each other among the plurality of sections provided in the heating furnace may be greater than 0° C. and 100° C. or less. For example, the temperature difference between the first section $P_1$ and the second section $P_2$ may be greater than 0° C. and 100° C. or less.

In an exemplary embodiment, the first temperature range $T_1$ of the first section $P_1$ may be 680° C. to 850° C. The second temperature range $T_2$ of the second section $P_2$ may be 700° C. to 900° C. The third temperature range $T_3$ of the third section $P_3$ may be 750° C. to 930° C. The fourth temperature range $T_4$ of the fourth section $P_4$ may be 800° C. to 950° C. The fifth temperature range $T_5$ of the fifth section $P_5$ may be Ac3 to 1000° C. For example, the fifth temperature range $T_5$ of the fifth section $P_5$ may be 830° C. and 1000° C. The sixth temperature range $T_6$ of the sixth section $P_6$ and the seventh temperature range $T_7$ of the seventh section $P_7$ may be the same as the fifth temperature range $T_5$ of the fifth section $P_5$.

The soaking operation (S130) may be performed after the multi-stage heating operation (S120). The soaking operation (S130) may be an operation of uniformly heating the blank to a temperature of Ac3 or higher in the last section among the plurality of sections provided in the heating furnace.

The soaking operation (S130) may be performed at the last part of the plurality of sections of the heating furnace. For example, the soaking operation (S130) may be performed in the fifth section $P_5$, the sixth section $P_6$, and the seventh section $P_7$ of the heating furnace. When the plurality of sections are provided in the heating furnace, when one section is long, a problem may be present in which a temperature change may occur in the above section. Therefore, the section in which the soaking operation (S130) is performed is divided into the fifth section $P_5$, the sixth section $P_6$, and the seventh section $P_7$, and the fifth section $P_5$, the sixth section $P_6$, and the seventh section $P_7$ may have the same temperature range in the heating furnace.

In the soaking operation (S130), the multi-stage heated blank may be soaked at a temperature of Ac3 to 1,000° C. Preferably, in the soaking operation (S130), the multi-stage heated blank may be soaked at a temperature of 830° C. to 1,000° C. In an atmosphere exceeding 1,000° C., there may be a risk that beneficial carbides in the steel are dissolved into a base material and the effect of grain refinement is lost.

In an exemplary embodiment, the heating operation (S200) includes a multi-stage heating operation (S210) and a soaking operation (S220), and thus, the temperature of the heating furnace may be set in stages, thereby improving the energy efficiency of the heating furnace.

In an exemplary embodiment, the heating furnace may have a length of 20 m to 40 m along the conveying path of the blank. The heating furnace may have the plurality of sections of different temperature ranges, and the ratio of a length $D_1$ of the section in which the blank is multi-stage heated among the plurality of sections and a length $D_2$ of the section in which the blank is soaked among the plurality of sections may satisfy 1:1 to 4:1. In other words, the length $D_2$ of a soaking section among the plurality of sections provided in the heating furnace may have a length of 20% to 50% of the total length $D_1+D_2$ of the heating furnace.

For example, among the plurality of sections, the section in which the blank is soaked may be the last section of the heating furnace (e.g., the fifth section $P_5$, the sixth section $P_6$, and the seventh section $P_7$). When the length of the soaking section of the blank increases and the ratio of the length $D_1$ of the section in which the blank is multi-stage heated and the length $D_2$ of the section in which the blank is soaked exceeds 1:1, a delay fracture may increase due to an increase in the amount of hydrogen penetration into the blank in the soaking section. In addition, when the length of the soaking section of the blank is reduced and the ratio of the length $D_1$ of the section in which the blank is multi-stage heated and the length $D_2$ of the section in which the blank is soaked is less than 4:1, the soaking period (time) is not sufficiently secured, and thus, the strength of components manufactured by the manufacturing process of the hot stamping component may be non-uniform.

In an exemplary embodiment, in the multi-stage heating operation (S120) and the soaking operation (S130), the blank may have a heating rate of about 6° C./s to 12° C./s, and a cracking time may be about 3 minutes to about 6 minutes. More specifically, when the thickness of the blank is about 1.6 mm to about 2.3 mm, the heating rate may be about 6° C./s to 9° C./s, and the cracking time may be about 3 minutes to about 4 minutes. In addition, when the thickness of the blank is about 1.0 mm to 1.6 mm, the heating rate may be about 9° C./s to 12° C./s, and the cracking time may be about 4 minutes to about 6 minutes.

Meanwhile, the conveying operation (S140), the forming operation (S150), and the cooling operation (S160) may be further performed after the soaking operation (S130).

The conveying operation (S140) may be an operation of conveying the soaked blank from the heating furnace to a press mold. In the operation of conveying the soaked blank from the heating furnace to the press mold, the soaked blank may be air-cooled for 5 seconds to 20 seconds.

The forming operation (S150) may be an operation of forming a molded body by hot stamping the conveyed blank. The cooling operation (S160) may be an operation of cooling the formed molded body.

A final product may be formed by cooling the molded body at the same time as being molded into a final component shape in the press mold. A cooling channel through which a refrigerant circulates may be provided in the press mold. The heated blank may be quenched by circulation of the refrigerant supplied through the cooling channel provided in the press mold. At this time, in order to prevent a spring back phenomenon of the plate material and to maintain the desired shape, quenching may be performed while pressurizing the press mold in a closed state. Upon forming and cooling the heated blank, the blank may be cooled at an average cooling rate of at least 10° C./s or greater to the end temperature of martensite. The blank may be maintained for 3 to 20 seconds in the press mold. When a maintenance time in the press mold is less than 3 seconds, sufficient cooling of the material is not achieved, a thermal deformation may occur due to the residual heat of the product and the temperature deviation of each component, resulting in deterioration in dimension quality. In addition, when the maintenance time in the press mold exceeds 20 seconds, the maintenance time in the press mold becomes long, and productivity may decrease.

In an exemplary embodiment, the hot stamping component manufactured by the manufacturing method of the hot stamping component described above may have a tensile strength of 1,680 MPa or greater, for example, 1,680 MPa or greater and 2,000 MPa or less, and include an area fraction of 95% of greater of a structure of martensite. In addition, the hot stamping component manufactured by the manufacturing method of the hot stamping component described above may be formed to have an average size of PAGs of 5 μm or greater and 25 μm or less, and include a fraction of 20% or greater of a low angle grain boundary, and a fraction of 5% to 10% of a special grain boundary among high angle grain boundary. When the hot stamping component satisfies the aforementioned range, resistance to hydrogen induced stress corrosion cracking may be sufficiently secured.

Hereinafter, the present disclosure will be described in more detail through exemplary embodiments and comparative examples. However, the following embodiments and comparative examples are for describing the present disclosure in more detail, and the scope of the present disclosure is not limited by the following embodiments and comparative examples. The following embodiments and comparative examples may be appropriately modified and changed by those of ordinary skill in the art within the scope of the present disclosure.

<Manufacture of Hot Stamping Component>

A hot stamping component according to an exemplary embodiment of the present disclosure may include a base steel sheet having the component system of Table 1. A plating layer by hot dip plating may be formed on the base steel sheet. The plating layer may include Al—Si—Fe. In the case of hot stamping component having the component system of Table 1, the tensile strength may be 1680 MPa or greater and the yield strength may be 950 MPa or greater.

TABLE 1

| Component (wt %) | | | | | | | | |
|---|---|---|---|---|---|---|---|---|
| C | Si | Mn | P | S | Cr | B | N | Ti |
| 0.28~0.35 | 0.15~0.50 | 0.8~1.6 | 0.018 or less | 0.005 or less | 0.10~0.30 | 0.0015~0.0050 | 0.005 or less | 0.025 to 0.045 |

<Stress corrosion cracking fracture experiment of hot stamping component>

As shown in Table 2 below, the average size of a PAB, the fraction of a low angle grain boundary, and the fraction of a special grain boundary were measured for each of embodiments and comparative examples. In addition, the stress corrosion cracking fraction results according to embodiments and comparative examples were measured.

Stress corrosion cracking (SCC) property evaluation method was measured by exposing a specimen to which bending stress (100% yield strength) is applied by a 4-point bending test to a cyclic corrosion test.

The cyclic corrosion test (CCT) is an experiment to find out a transition state of a material found in a corrosion situation in a natural state, and measures hydrogen induced cracking of steel materials by arbitrarily creating a wet and acidic atmosphere. More specifically, one cycle of immersion in salt water for about 5 hours under conditions at a temperature of 40° C. and humidity of 95% RH (first operation), forcible drying under conditions at a temperature of 70° C. and humidity of 30% RH for about 2 hours (second operation), exposure to a humid environment at a temperature of 50° C. and humidity of 95% RH for about 3 hours (third operation), and finally forcible drying under conditions of temperature of 60° C. and humidity of 30% RH for about 2 hours (fourth operation) was performed 60 times (70 hours).

TABLE 2

| Classification | Prior austenite Average size (μm) | Fraction of low angle grain boundary (Vol. %) | Fraction of special grain boundary (Vol. %) | Stress Corrosion Crack Fracture Results |
|---|---|---|---|---|
| Embodiment 1 | 13 | 35 | 8.2 | Not Fractured |
| Embodiment 2 | 15 | 31 | 7.1 | Not Fractured |
| Embodiment 3 | 18 | 28 | 6.5 | Not Fractured |
| Embodiment 4 | 21 | 21.3 | 8.0 | Not Fractured |
| Embodiment 5 | 25 | 20.8 | 9.1 | Not Fractured |
| Embodiment 6 | 24 | 20.9 | 5.9 | Not Fractured |
| Comparative Example 1 | 34 | 15 | 1.5 | Fractured |
| Comparative Example 2 | 27 | 19 | 1.1 | Fractured |
| Comparative Example 3 | 39 | 14 | 2.0 | Fractured |

As disclosed in Table 2, in the case of Embodiments 1 to 6, the average size of PAGs of 5 μm or greater and 25 μm or less was formed, the fraction of 20% or greater of the low angle grain boundary, and the fraction of 5% to 10% of the special grain boundary among the high angle grain boundary were measured. On the other hand, in Comparative Examples 1 to 3, it may be seen that the average size of PAGs, the fraction of the low angle grain boundary, and the fraction of the special grain boundary among the high angle grain boundary were all out of the above ranges. As a result, it may be seen that Examples 1 to 6 satisfying the above ranges were not fractured during stress corrosion cracking evaluation, whereas Comparative Examples 1 to 3 out of the above ranges were fractured during stress corrosion cracking evaluation.

According to the above experiment results, in the case of the hot stamping component according to the present disclosure having the average size of PAGs of 5 μm or greater and 25 μm or less, the fraction of 20% or greater of the low angle grain boundary, and the fraction of 5% to 10% of the special grain boundary among high angle grain boundary, it may be seen that resistance to stress corrosion cracking due to hydrogen diffusion is improved in the same stress and corrosion environment.

Figure 7:
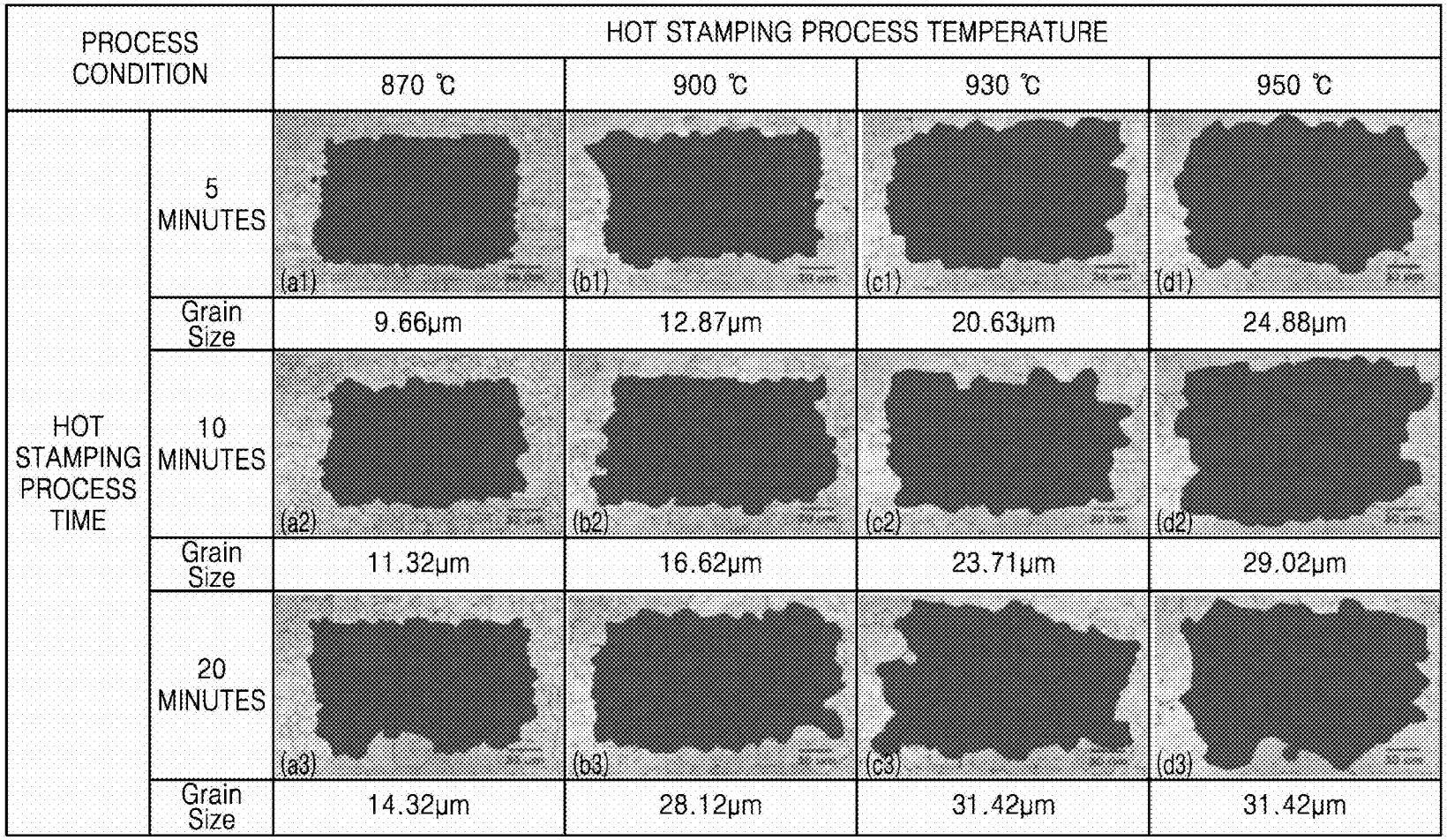
FIG. 7 shows images of measuring prior austenite grain (PAG) sizes in a hot stamping component according to the total dwell time in a heating furnace and a final temperature in the heating furnace.
Figure 8:
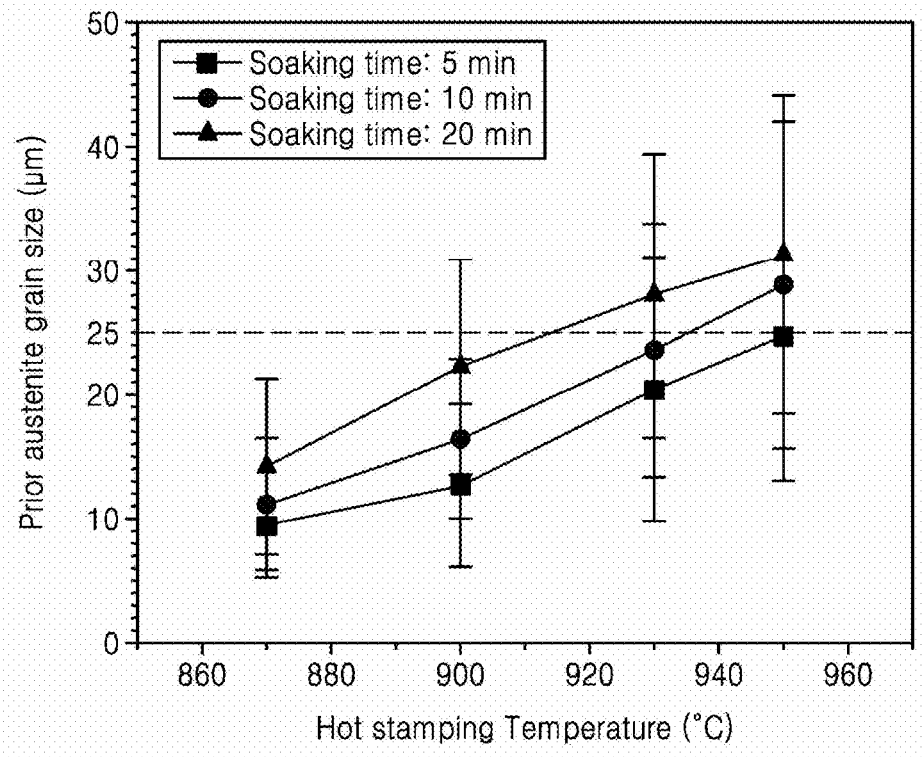
FIG. 8 shows a schematic graph of PAG sizes of the embodiment of FIG. 7 and comparative example.
Figure 9:
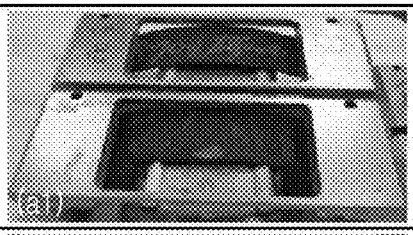
FIG. 9 shows images showing results of a 4-point bending test for each of the embodiment and comparative example.
Figure 9:
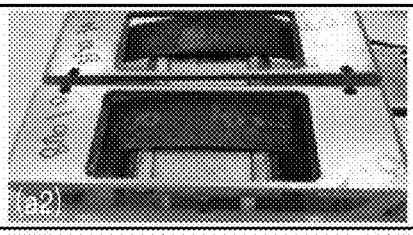
Figure 9:
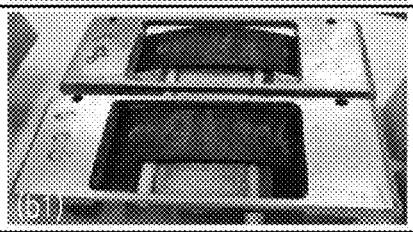
Figure 9:
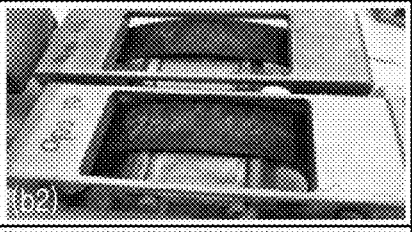
Figure 9:
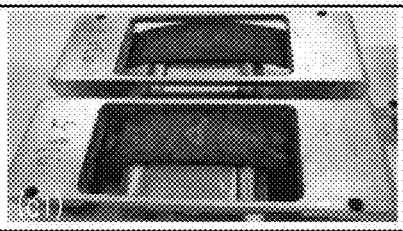
Figure 9:
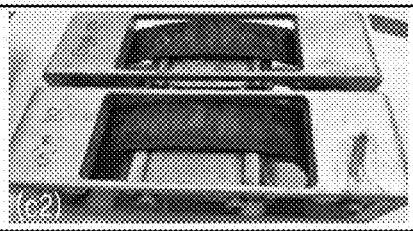
Figure 9:
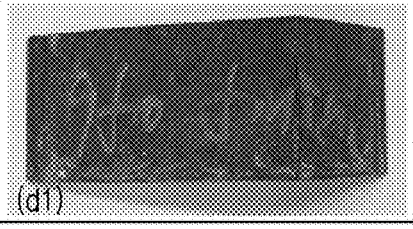
Figure 9:
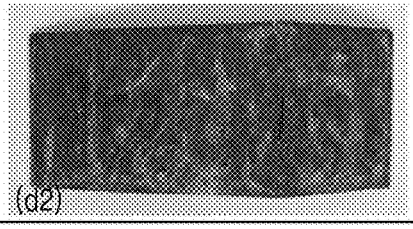

FIG. 7 shows images of measuring PAG sizes in a hot stamping component according to the total dwell time in a heating furnace and a final temperature in the heating furnace. FIG. 8 shows a schematic graph of PAG sizes of the exemplary embodiment of FIG. 7 and comparative example. FIG. 9 is images showing results of a 4-point bending test for each of the exemplary embodiment and comparative example.

Referring to FIGS. 7 and 8, the final temperature in the heating furnace was set to 870° C., 900° C., 930° C., and 950° C., and the soaking time in the heating furnace was controlled to 5 minutes, 10 minutes, and 20 minutes according to the respective temperatures. Through this, it may be confirmed that the PAG sizes in the hot stamping component vary depending on the total soaking time in the heating furnace and the final temperature in the heating furnace. That is, the PAG sizes in the hot stamping component may be controlled by setting the total soaking time in the heating furnace and the final temperature in the heating furnace during a hot stamping process.

Specifically, in the case of specimens (a1), (a2), and (a3) staying at the final temperature of 870° C. for 5 minutes, 10 minutes, and 20 minutes, respectively, PBG average sizes were respectively measured as 9.66 μm, 11.32 μm, and 14.32 μm, in the case of specimens (b1), (b2), and (b3 staying at the final temperature of 900° C. for 5 minutes, 10 minutes, and 20 minutes, respectively, PBG average sizes were respectively measured as 12.87 μm, 16.62 μm, and 28.12 μm, in the case of specimens (c1), (c2), and (c3) staying at the final temperature of 930° C. for 5 minutes, 10 minutes, and 20 minutes, respectively, PBG average sizes were respectively measured as 20.63 μm, 23.71 μm, and 31.42 μm, and in the case of specimens (d1), (d2), and (d3), staying at the final temperature of 950° C. for 5 minutes, 10 minutes, and 20 minutes, PBG average sizes were respectively measured as 25.88 μm, 29.02 μm, and 31.42 μm. As may be seen from this, as the heat treatment temperature and time increase in the hot stamping process, it may be seen that the PAG size is coarsened. In particular, it may be seen that the coarsening of the PAG size tends to intensify at the temperature exceeding 930° C.

As a result, as shown in FIG. 9, it may be seen that specimens (a1), (a2), (b1), (b2), (c1) and (c2) having the PBG average size of less than 25 μm have not been fractured during the 4-point bending test, whereas specimens (d1) and (d2) having the PBG average size exceeding 25 μm have been fractured during the 4-point bending test.

Although the present disclosure has been described with reference to an example shown in the drawings, it will be understood by those of ordinary skill in the art that various modifications and equivalent other examples may be made from the shown example. Accordingly, the true technical scope of the present disclosure should be defined by the technical spirit of the appended claims.

The invention claimed is:

1. A hot stamping component having a tensile strength of 1680 MPa or greater, the hot stamping component comprising:

a microstructure comprising prior austenite grains (PAGs), wherein an average grain diameter of the PAGs is 10 μm or more and 25 μm or less, wherein, as grain boundaries forming interfaces of the microstructure, the microstructure includes a low-angle grain boundary having a grain angle of 0 degrees or greater and 15 degrees or less and a high-angle grain boundary having a grain angle of greater than 15 degrees and 180 degrees or less, wherein a fraction of the low-angle grain boundary is 20% or greater, wherein the high-angle grain boundary includes a special grain boundary having a regular atomic arrangement, the special grain boundary being a twinning boundary or a coherent Σ3 boundary, and a random grain boundary having an irregular atomic arrangement, wherein a fraction of the special grain boundary among the high-angle grain boundaries is 5% or greater and 10% or less, and wherein a fraction of the random grain boundary among the high-angle grain boundaries is 70% or less.

2. The hot stamping component of claim 1, further comprising: a martensite phase having an area fraction of 95% or greater in the hot stamping component.

3. The hot stamping component of claim 1, further comprising: a base steel sheet, wherein the base steel sheet comprises, with respect to a total weight of the base steel sheet, an amount of 0.28 wt % to 0.50 wt % of carbon (C), an amount of 0.15 wt % to 0.7 wt % of silicon (Si), an amount of 0.5 wt % to 2.0 wt % of manganese (Mn), an amount of 0.03 wt % or less of phosphorus (P), an amount of 0.01 wt % or less of sulfur(S), an amount of 0.1 wt % to 0.6 wt % of chromium (Cr), an amount of 0.001 wt % to 0.005 wt % of boron (B), at least one of titanium (Ti), niobium (Nb), and molybdenum (Mo), and the balance of iron (Fe) and other unavoidable impurities.

* * * * *